United States Patent [19]

Shores

[11] 4,334,201

[45] Jun. 8, 1982

[54] YIG BANDPASS FILTER INTERCONNECTED BY MEANS OF LONGITUDINALLY SPLIT COAXIAL TRANSMISSION LINES

[75] Inventor: David H. Shores, Lake Oswego, Oreg.

[73] Assignee: Tektronix, Inc., Beaverton, Oreg.

[21] Appl. No.: 944,436

[22] Filed: Sep. 21, 1978

[51] Int. Cl.[3] ..... H01P 1/217; H01P 7/06; H01P 1/209

[52] U.S. Cl. ..... 333/202; 333/209; 333/231

[58] Field of Search ..... 333/1.1, 24.1, 73 C, 333/73 S, 73 R, 73 W, 222-223, 243, 227-228, 219, 235, 202, 208-212, 231; 325/446

[56] References Cited

U.S. PATENT DOCUMENTS

| | | | |
|---|---|---|---|
| 3,102,244 | 8/1963 | Seidel | 333/243 |
| 3,268,838 | 8/1966 | Matthaei | 333/73 R |
| 3,299,376 | 1/1967 | Blau et al. | 333/73 R |
| 3,435,385 | 3/1969 | Cohen | 333/73 C |
| 3,480,888 | 11/1969 | Elliott | 333/73 C |
| 3,504,305 | 3/1970 | Cohen | 333/24.1 |
| 3,801,936 | 4/1974 | Roschmann | 333/73 C |

OTHER PUBLICATIONS

Venator-"Charting a Simpler Course to the Design of YIG Filters", Electronics, Mar. 3, 1969; pp. 118-126.

White-"Spin Waves and Magnetostatic Modes", Journal of Appied Physics, Supplement to vol. 31, No. 5, May 1960; pp. 86S-94S.

Cristal-Theory and Tables of Optimum Symmetrical Tem-Mode Coupled-Transmission-Line Directional Coupers", IEEE Trans. on Microwave Theory and Techniques, vol. MTT-13, No. 5, Sep. 1965; pp. 544-558.

Tokheim-"Equivalent Circuits Aid YIG Filter Design", Microwaves, Apr. 1971; pp. 54-59.

Thomas-"A Practical Introduction to Impedance Matching", Artech House, Inc., Dedham, Mass, Copyrighted 1976; pp. 3-13.

"Microwave Transmission Design Data"-Sperry Gyroscope Company, Inc., Received Scientific Library, May 9, 1966; Title Page and pp. 2-3.

*Primary Examiner*—Marvin L. Nussbaum

[57] ABSTRACT

An electronically tunable YIG microwave filter with a two-piece housing is described. The two-piece housing makes possible the fabrication of small holes deep within the filter housing for mounting the filter components. This filter uses the center conductors of its input and output coaxial cables as input and output coupling loops.

6 Claims, 6 Drawing Figures

YIG BANDPASS FILTER INTERCONNECTED BY MEANS OF LONGITUDINALLY SPLIT COAXIAL TRANSMISSION LINES

BACKGROUND OF THE INVENTION

This invention relates generally to electronically tunable microwave filters. In particular, it relates to the class of filters utilizing yttrium-iron-garnet (YIG) spheres. Filters of this type are well known in the art, and the invention lies in specific construction details which provide improved filter performance.

Those desiring information on the theory of ferrimagnetic devices are referred to "Principles of Microwave Ferrite Engineering" by J. Helszajn, copyright 1969, John Wiley & Sons, Ltd. The design of YIG filters is described in "Equivalent Circuits Aid YIG Filter Design" by Robert E. Tokheim, Microwaves, April, 1971, pp. 54–59.

Conventional YIG filters utilize a single piece housing in which to mount the YIG spheres, coupling loops, coaxial cables, and their associated mounting parts. Several problems are inherent in this construction method. For example, large (that is, large in relation to the typical coupling loop wire diameter of 0.004 inches) holes must be drilled through the housing in order to permit the coaxial cables to be fed to the YIG sphere cavity. If the transition from the coaxial cable center conductor to a coupling loop is made at the cavity edge, the coupling to spurious magnetostatic modes is greatly increased. If, on the other hand, the transition is made too far away from the edge, inductance is added to the filter causing the input coupling to change as the filter frequency is tuned.

Described in U.S. Pat. No. 3,435,385 is an electronically tunable microwave YIG filter which uses perpendicular loops to couple energy to and away from the YIG spheres, but construction of the housing for the YIG spheres is not described.

SUMMARY OF THE INVENTION

The present invention is a new housing and mounting system for YIG tuned microwave filters. The YIG sphere housing is split into two sections or rings; thus, allowing the fabrication of small holes deep within the housing. These small holes facilitate mounting the various components of the filter and yield improved electrical performance.

It is, therefore, among the objects of the present invention to provide a YIG tuned microwave filter with less passband ripple due to spurious magnetostatic modes.

Another object of the present invention is to provide a filter with less passband ripple due to coupling variation as the filter frequency is tuned.

A further object of the present invention is to provide a filter that has improved off resonance isolation per filter section and thereby reduce the number of filter sections required.

A still further object of the present invention is to provide a filter with reduced assembly and test time.

The subject matter of the present invention is particularly pointed out and distinctly claimed in the following description. The invention, however, both as to organization and method of operation together with further advantages and objects thereof may best be understood by reference to the following description taken in conjunction with the accompanying drawings wherein like reference numerals refer to like elements. It is to be understood, however, that these embodiments are not intended to be exhausting nor limiting of the invention but are for the purpose of illustration in order that others skilled in the art may fully understand the invention and principles thereof and the manner of applying it in particular use so that they may modify it in various forms, each as may best be suited to the conditions of the particular use.

DESCRIPTION OF THE PREFERRED EMBODIMENT

Figure 1:
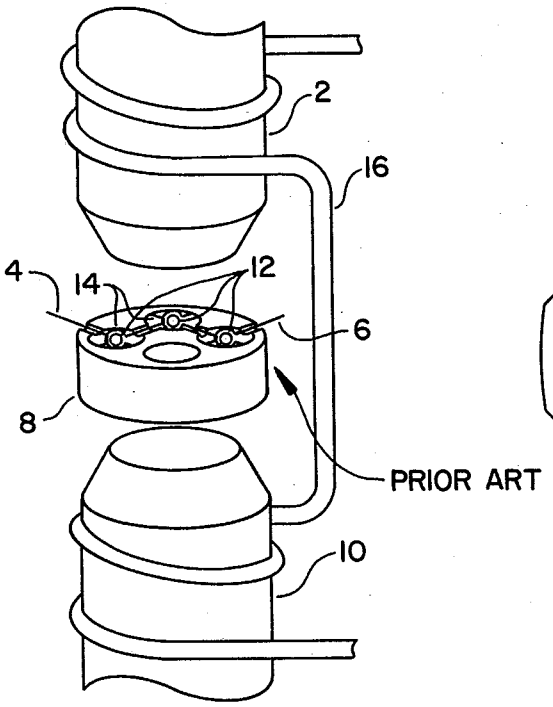
FIG. 1 is a simplified drawing of a conventional YIG filter showing the prior art housing.

Referring now to the drawings, FIG. 1 is a simplified drawing of a conventional YIG filter. Housing 8 is located between pole pieces 2 and 10. YIG spheres 12 and coupling loops 14 are mounted within housing 8. Current flowing through conductor 16 produces a magnetic field between pole pieces 2 and 10. The RF signal to be filtered enters the filter at input coupling loop 4 and the filtered signal exits at output coupling loop 6. Interstage coupling loops 14 couple the RF energy from one YIG sphere to the other.

As is well known, when a dc magnetic field is applied to yttrium iron garnet, the material exhibits a high-Q resonance at a frequency proportional to the strength of the magnetic field. Known as the gyromagnetic frequency, it can be changed by changing the strength of the magnetic field. The filter shown in FIG. 1 consists of three cascaded filter sections, each section containing a YIG sphere 12 with its coupling loops arranged so that their axes are perpendicular to each other and the magnetic field. When the YIG sphere is not magnetized, no energy is transferred between the coupling loops because as mentioned previously the loops axes are perpendicular to each other and there is no interaction with the YIG sphere. When a dc field is applied along the Z-axis, and the frequency of the applied RF signal is the same as the gyromagnetic frequency, energy is transferred between the coupling loops by means of the transverse components of the dipolar field of the YIG spheres.

The present invention is a filter with an improved housing which, because of its construction, overcomes many of the problems inherent in the filter shown in FIG. 1. The present invention can be best understood by referring to FIG. 2.

Figure 2A:
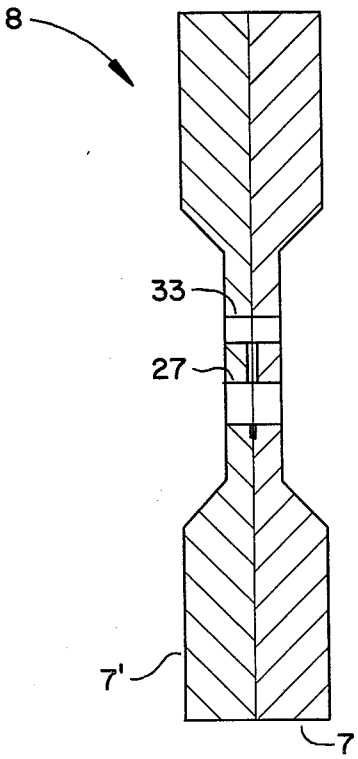
FIG. 2A is a view through section 2A of FIG. 2.
Figure 2:
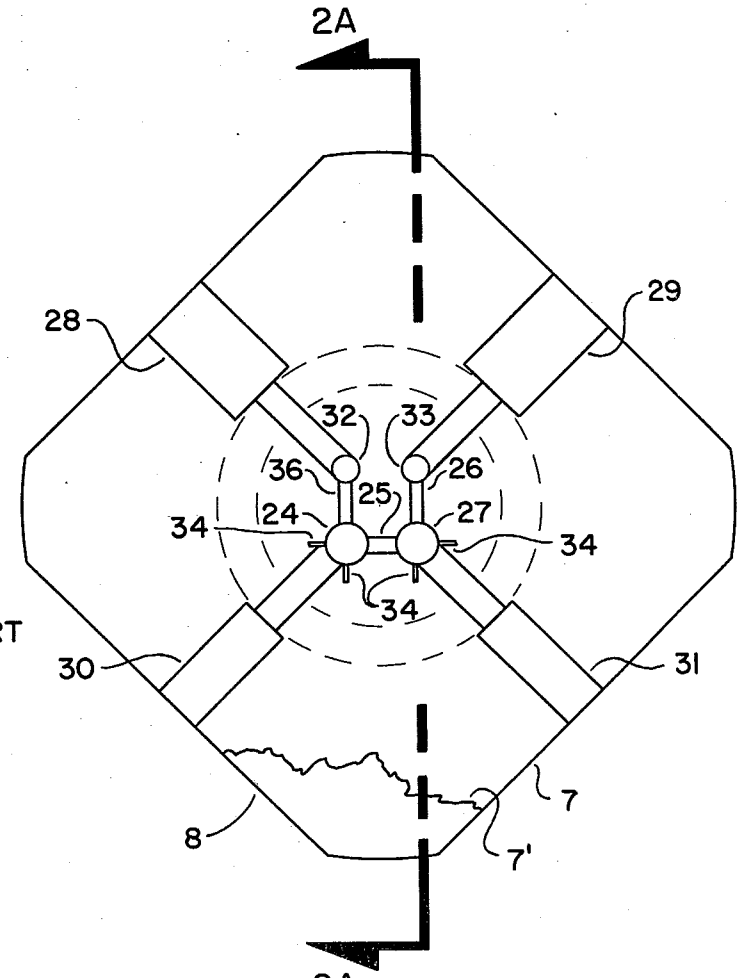
FIG. 2 is a top view of the present invention with the top cut away to reveal the mounting channels.

FIG. 2 shows a top view of the housing 8 according to the present invention with the top ring 7' cut away. The top ring 7' and bottom ring 7 of housing 8 are constructed of a powdered metal, such as German Silver. The powdered metal is placed in a mold and subjected to a sintering process. However, any other suitable material and process may be used to fabricate the housing rings. The two rings are placed one on top of the other to form housing 8.

When the two housing rings are assembled, small concave channels molded in one ring mate with the corresponding channels in the other ring to form small latitudinal holes deep within the housing. Channel 28 allows the input coaxial cable to enter the housing while channel 29 allows the output coaxial cable to enter the housing. Hole 32 is where the input coaxial cable center conductor is welded to the input coupling loop which is mounted in channel 36. The YIG spheres are mounted in cavities 24 and 27. The housing 8 shown in FIG. 2 is for a two-stage filter and is presented for purposes of illustration only. Any number of filter stages may be utilized to suit each particular application. The YIG spheres are mounted on alumina rods and inserted into cavities 24 and 27 through channels 30 and 31, respectively. The interstage coupling loop is mounted in channel 25 and the output coupling loop is mounted in channel 26. Hole 33 is where the output coupling loop is welded to the output coaxial cable center conductor. The coupling loops are precisely positioned since the ends thereof fit in channels 34 which, in the preferred embodiment are 0.006 inches wide, 0.020 inches long and 0.0015 inches deep.

Figure 3:
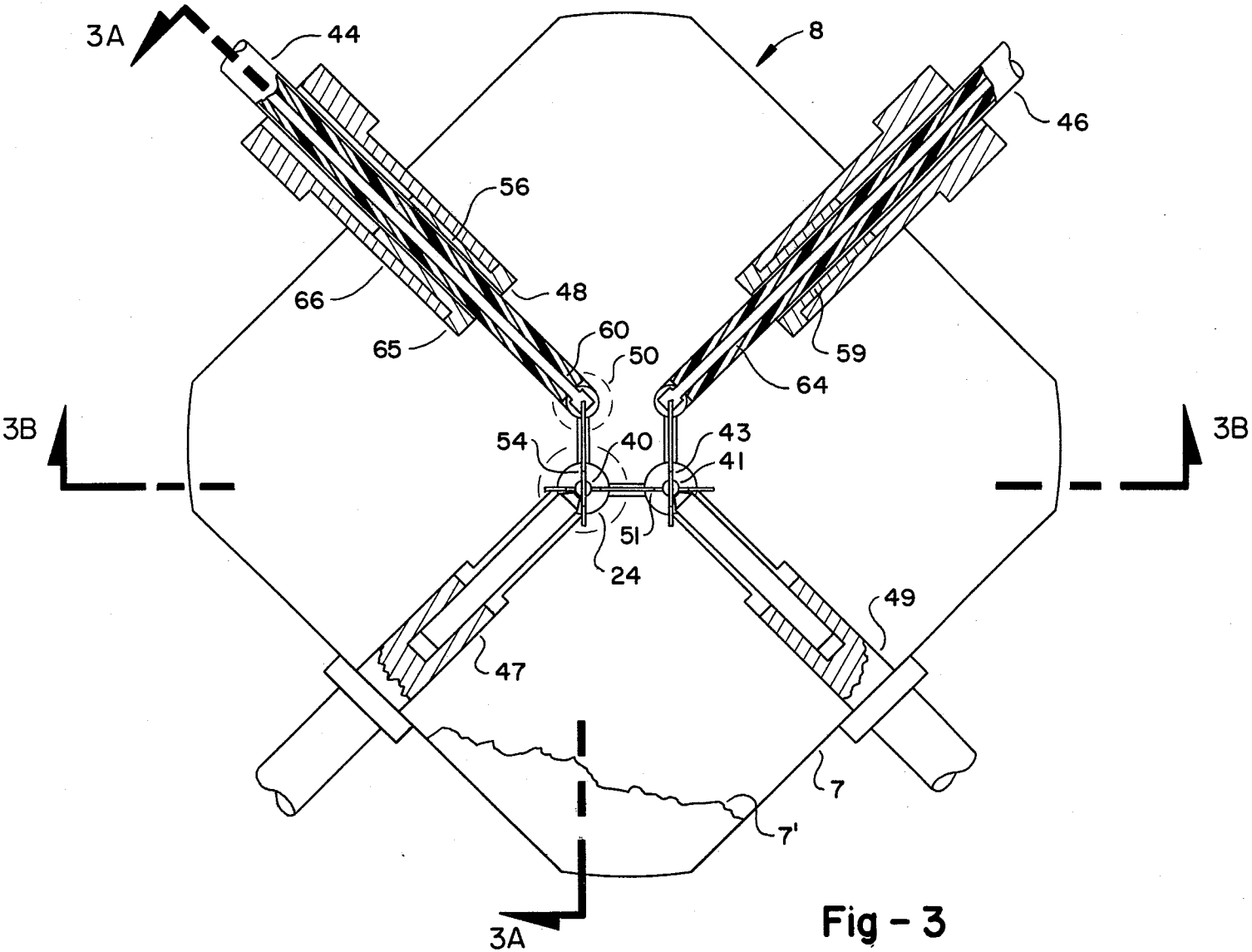
FIG. 3 is a top view of the present invention with the filter components mounted therein.

FIG. 3 is a top view of an assembled housing 8 with the components of the YIG filter mounted therein. The top ring 7' has been cut away in order to facilitate viewing of the filter components.

Figure 3A:
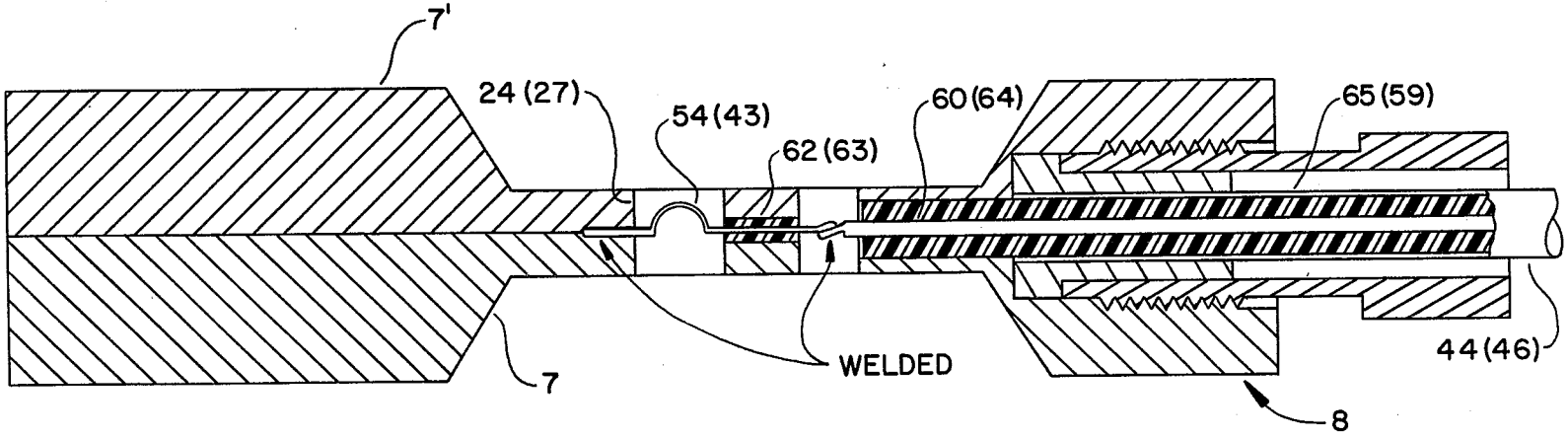
FIG. 3A is a view through section 3A of FIG. 3.

Input coaxial cable 44 is mounted in channel 28 by means of soldered on ferrule 65 and retaining screw 66. The center conductor 60 of the cable is welded to the center conductor 54 of coaxial cable 62; channel 36 is the outer conductor. These mounting details may be better understood by referring to FIG. 3A wherein is shown a view through section 3A—3A of FIG. 3. The section through 3A—3A shows the input and output coupling mounting details. However, since the input and output coupling are identical, only one drawing is provided (the reference numerals in parentheses refer to the output coupling). It can be seen from FIGS. 3 and 3A that center conductor 54 is, in fact, the input coupling loop to the YIG sphere cavity 24 where sphere 40 is mounted. Using center conductor 54 as the input coupling loop, minimizes the discontinuity of the transmission line entering the YIG sphere cavity 24 thereby providing maximum symmetry of the RF fields near the YIG sphere. RF field symmetry is essential for minimizing coupling to spurious magnetostatic modes. In the preferred embodiment of the present invention, the transition from a 0.038-inch outside diameter coaxial cable to a 0.15-inch by 0.010-inch rectangular coaxial transmission line (channel 36) is accomplished by welding their center conductors together at area 50. The outer conductor 56 of input coaxial cable 44 feeds ground current to the housing at surface 48. Thus, ground current discontinuities are kept distant from the critical interface between the input coupling loop 54 and the YIG sphere cavity 24 further improving the RF field symmetry.

The characteristic impedance of coaxial cable 62 is 50 ohms, which minimizes the amount of filter passband ripple due to coupling variations as frequency is tuned. The usual practice in prior designs was to make the connection between the input coaxial cable and the coupling loop some distance from the YIG sphere cavity in order to reduce spurious magnetostatic modes. This was done because it was not previously feasible to make a hole within the housing small enough to serve as a 50-ohm outer conductor for the 0.004-inch diameter wire inner conductor. Thus, the length of transmission line between the connection and the coupling loop is a high impedance and thereby inductive. This inductance causes the amount of energy coupled to the YIG spheres to change appreciably as the frequency of the filter is tuned. In the present invention, very little inductance is introduced by coaxial cable 62 because its characteristic impedance is low.

Figure 3B:
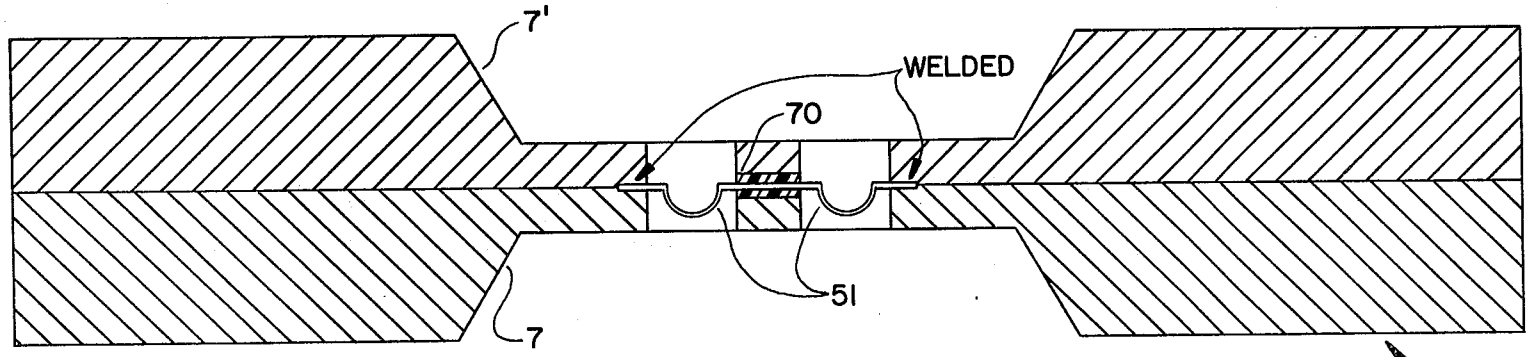
FIG. 3B is a view through section 3B of FIG. 3.

FIG. 3B shows the interstage coupling arrangement of the present invention. As shown in FIG. 3B, interstage coupling loop 51 is the center conductor of coaxial cable 70. These loops couple RF energy from the input coupling loop 54 to the output coupling loop 43 via the YIG spheres. As with previous filters, out-of-band coupling between the input loop and interstage loop is minimized by making the two loops orthogonal. This undesirable coupling is further reduced by using half-loops on opposite sides of YIG spheres. However, in prior designs channel 25 is a short, large diameter hole. This hole is designed to be a waveguide below cutoff (for non-TEM modes), but because of its short length it provides very little attenuation to out-of-band frequencies. In the present device, channel 25 has a length about three times its diameter thus it provides excellent attenuation. Consequently, the present device has been used to construct a two-section filter that has the same amount of out-of-band rejection that a three-section filter constructed according to previous methods provide.

The construction of output coupling loop 43 and its connection to the output coaxial cable 46 is identical to that described for input coupling loop 54 and therefore no detailed description is given.

While there has been shown and described the preferred embodiment of the present invention, it will be apparent to those skilled in the art that many changes and modifications may be made without departing from the invention in its broader aspects. Therefore, the appended claims are intended to cover all such changes and modifications that fall within the true spirit and scope of the invention.

I claim:

1. A magnetic field-tunable filter comprising (a) a nonmagnetic metallic housing; (b) a cavity formed within said housing; (c) a ferrimagnetic resonator element supported within said cavity; (d) a passage leading from said cavity to an external surface of said housing; and (e) a coupling structure including an elongate conductor extending centrally through said passage into said cavity to couple magnetically with said resonator element;

characterized in that (1) said passage is composed of plural sections of different diameter, including one section of smaller diameter communicating with said cavity, and another section of larger diameter opening into said external surface, and (2) said housing comprises first and second members joined along the longitudinal centerline of said passage.

2. The filter of claim 1, wherein said ferrimagnetic resonator element is a yttrium-iron-garnet sphere.

3. A magnetic field-tunable microwave filter comprising (a) a nonmagnetic metallic housing; (b) a pair of cavities formed at spaced-apart locations within said housing; (c) a pair of ferrimagnetic resonator elements, each one supported within a different one of said cavities; (d) an input and an output passage, each one leading from a different one of said cavities to an external surface of said housing; (e) an interstage passage extending between said cavities; (f) an input and an output coupling structure, each including an elongate conductor extending centrally through the corresponding input/output passage into the adjoining cavity to couple magnetically with the resonator element therein; and (g) an interstage coupling structure comprising an elongate conductor extending centrally through the interstage passage and into each cavity to couple magnetically with the resonator elements therein;

characterized in that (1) said input and output passages are comprised of plural sections of different diameter, including one section of smaller diameter communicating with the respective cavity, and another section of larger diameter opening into said external surface; and (2) said housing comprises first and second members joined along the longitudinal centerlines of said passages.

4. The filter of claim 3, wherein said ferrimagnetic resonator elements are yttrium-iron-garnet spheres.

5. The filter of claim 3, further characterized in that the centerlines of said passages lie in a common plane.

6. The filter of claim 3, wherein said smaller and larger diameter sections of the input/output passages extend in different directions within said housing.

* * * * *

UNITED STATES PATENT AND TRADEMARK OFFICE

CERTIFICATE OF CORRECTION

PATENT NO. : 4,334,201

DATED : June 8, 1982

INVENTOR(S) : David H. Shores and William P. Hargreaves

It is certified that error appears in the above—identified patent and that said Letters Patent is hereby corrected as shown below:

On the cover sheet, left column, add WILLIAM P. HARGREAVES, Beaverton, Oreg. as a co-inventor.

Signed and Sealed this

*Sixteenth* Day of *August 1983*

[SEAL]

*Attest:*

GERALD J. MOSSINGHOFF

*Attesting Officer*

*Commissioner of Patents and Trademarks*